US008248345B2

(12) United States Patent
Chen et al.

(10) Patent No.: US 8,248,345 B2
(45) Date of Patent: Aug. 21, 2012

(54) DISPLAY APPARATUS AND METHOD FOR DISPLAYING AN IMAGE

(75) Inventors: Ken-Ming Chen, Hsinchu (TW); Chi-Mao Hung, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 902 days.

(21) Appl. No.: 12/102,198

(22) Filed: Apr. 14, 2008

(65) Prior Publication Data

US 2009/0189838 A1 Jul. 30, 2009

(30) Foreign Application Priority Data

Jan. 28, 2008 (TW) ..... 97103086 A

(51) Int. Cl.
*G09G 3/36* (2006.01)
*G09G 5/00* (2006.01)

(52) U.S. Cl. ..... 345/96; 345/209; 349/37

(58) Field of Classification Search ..... None
See application file for complete search history.

(56) References Cited

U.S. PATENT DOCUMENTS

| | | | | |
|---|---|---|---|---|
| 6,342,876 | B1 | 1/2002 | Kim | |
| 6,469,684 | B1 * | 10/2002 | Cole | 345/58 |
| 6,570,553 | B2 | 5/2003 | Hashimoto et al. | |
| 7,098,884 | B2 * | 8/2006 | Onoya | 345/96 |
| 7,109,964 | B2 | 9/2006 | Pai | |
| 7,551,157 | B2 * | 6/2009 | Tanaka et al. | 345/98 |
| 7,623,106 | B2 * | 11/2009 | Onoya | 345/96 |
| 2004/0178980 | A1 * | 9/2004 | Rao et al. | 345/96 |
| 2004/0178981 | A1 | 9/2004 | Asada et al. | |
| 2004/0207592 | A1 * | 10/2004 | Ludden | 345/96 |
| 2005/0104834 | A1 * | 5/2005 | Tsuchihashi | 345/96 |
| 2006/0267898 | A1 * | 11/2006 | Onoya | 345/96 |
| 2007/0115237 | A1 * | 5/2007 | Hirakata | 345/96 |
| 2007/0159435 | A1 * | 7/2007 | Jiang et al. | 345/96 |
| 2007/0229430 | A1 * | 10/2007 | Wang et al. | 345/96 |
| 2007/0229431 | A1 * | 10/2007 | Kang et al. | 345/96 |
| 2007/0252803 | A1 * | 11/2007 | Fukui et al. | 345/96 |
| 2008/0074568 | A1 * | 3/2008 | Tanaka et al. | 349/37 |
| 2008/0088556 | A1 * | 4/2008 | Min et al. | 345/87 |
| 2008/0088615 | A1 * | 4/2008 | Chen et al. | 345/209 |
| 2008/0170025 | A1 * | 7/2008 | Song et al. | 345/96 |
| 2008/0198283 | A1 * | 8/2008 | Yoon et al. | 349/37 |
| 2010/0207959 | A1 * | 8/2010 | Qi et al. | 345/597 |

OTHER PUBLICATIONS

Chinese language office action dated Dec. 25, 2009.
English language translation of abstract and pertinent parts of CN 1530723 (published Sep. 22, 2004).

* cited by examiner

*Primary Examiner* — Bipin Shalwala
*Assistant Examiner* — Daniel Bedell
(74) *Attorney, Agent, or Firm* — Thomas, Kayden, Horstemeyer & Risley, LLP

(57) ABSTRACT

A display apparatus and a method for displaying an image are provided. The display apparatus includes a pixel array, a polarity (POL) signal generator, and a drive circuit. The pixel array which includes a plurality of pixels is configured to display a plurality of frames of the image. The POL signal generator is configured to generate a plurality of POL signals. The drive circuit is configured to adjust the frames of the image according to the POL signals, and output the frames to the pixel array.

6 Claims, 9 Drawing Sheets

DISPLAY APPARATUS AND METHOD FOR DISPLAYING AN IMAGE

This application claims the benefit from the priority of Taiwan Patent Application No. 097103086, filed on Jan. 28, 2008, the contents of which are incorporated herein by reference in their entirety.

CROSS-REFERENCES TO RELATED APPLICATIONS

Not applicable.

BACKGROUND OF THE INVENTION

1. Field of the Invention

The present invention relates to a display apparatus and a method for a pixel array to display an image. More particularly, the present invention relates to a display apparatus with a system-on-glass (SOG) and a method for a pixel array to display an image.

2. Descriptions of the Related Art

Over recent years, flat panel displays have gradually replaced conventional cathode ray tube (CRT) displays due to the rapid pace of developing the flat panel displays. Flat panel displays currently available primarily fall into the following categories: organic light-emitting diode displays (OLEDs), plasma display panels (PDPs), liquid crystal displays (LCDs), and field emission displays (FEDs). Among these flat panel displays, the LCDs have become the main product in the display market because of their advantages, such as low power consumption, a light weight, thin profile, and high definition.

LCDs typically adopt external drive circuits, control circuits and data circuits to connect to an array of the LCD. LCD manufacturers usually integrate these drive circuits, control circuits and data circuits into a single printed circuit board (PCB). Flexible wires are configured to connect the PCB to the array. To further compress the volume of an LCD, manufacturers have developed a manufacturing technology known as the SOG, i.e., the drive circuits and control circuits are formed directly on the array instead of being separately formed. This technology may save space and lower the cost of the drive circuits and control circuits that would otherwise be independently formed.

However, the driver circuits on array are inferior to the external drive circuits with regards to their driving capability. As a result, gate driver cannot adequately be charged, mostly resulting in degraded driving pixels on the array. In view of this, manufacturers have developed particular driving methods to prevent of the inadequate driving capability that occurs in the driving circuits of an LCD adopting the SOG technology.

As shown in FIG. 1A, an LCD 1 using an SOG generally comprises a drive integrated circuit (IC) 11, a first gate circuit 13 of gate driver on array (GOA), a second gate circuit 15, a plurality of scan lines (for simplicity, only 101*b*, 101*g*, 101*r*, 103*b*, 103*g*, 103*r*, 105*b*, 105*g*, 105*r* are denoted in FIG. 1A), and a plurality of pixels. The drive IC 11 is configured to send a first clock signal 10 and a first inverted clock signal 14 to the first gate circuit 13, and also to send a second clock signal 12 and a second inverted clock signal 16 to the second gate circuit 15. The first gate circuit 13 and the second gate circuit 15 may control the ON and OFF status of the pixels connected with each of the scan lines 101*b*, 101*g*, 101*r*, 103*b*, 103*g*, 103*r*, 105*b*, 105*g*, 105*r* according to the first clock signal 10, the first inverted clock signal 14, the second clock signal 12 and the second inverted clock signal 16 respectively. By sending the image data DATA from the drive IC 11 to the pixels and controlling the ON and OFF status of the corresponding pixels, an image can be displayed on the LCD 1. When the first gate circuit 13 turns on the scan line 101*b* and writes data DATA, the second gate circuit 15 turns on the scan line 101*g* to pre-charge the pixels on the scan line 101*g* before writing the data DATA to enhance the driving capability of the LCD 1. However, this method of improving the driving capability by pre-charging the pixels will result in two scan lines that will be turned on during the same time period. This may cause the image data DATA sent by the drive IC 11 to be written into the pixels on two adjacent scan lines, thus leading to errors in data writing and the erroneous display of the image on the LCD 1.

In the following description, various driving methods of pre-charging the pixels on the scan lines will be described respectively. FIG. 1B is a schematic clock diagram of individual scan lines that adopt the dot inversion driving method. When the LCD 1 is displaying the Nth frame of an image, the first gate circuit 13 turns on the scan line 101*b* during a period 100*p* of the first clock signal 10 to pre-charge the pixels on the scan line 101*b* before the data on the scan line 101*b* is outputted to pixels thereon. Subsequently, the data on the scan line 101*b* is outputted by the drive IC 11 to the pixels on the scan line 101*b* during a period 100 of the first clock signal 10. Meanwhile, the second gate circuit 15 turns on the scan line 101*g* during a period 102*p* of the second clock signal 12 to pre-charge the pixels on the scan line 101*g*. Then, the data on the scan line 101*g* is outputted by the drive IC 11 to the pixels on the scan line 101*g* during a period 102 of the second clock signal 12. Meanwhile, the first gate circuit 13 turns on the scan line 101*r* during a period 104*p* of the first inverted clock signal 14 to pre-charge the pixels on the scan line 101*r*. Next, the data on the scan line 101*r* is outputted by the drive IC 11 to the pixels on the scan line 101*r* during a period 104 of the first inverted clock signal 14. Similarly, when the data on the scan line 101*r* is being outputted to the pixels on the scan line 101*r* during the period 104 of the first inverted clock signal 14, the second gate circuit 15 turns on the scan line 103*b* during a period 106*p* of the second inverted clock signal 16 to pre-charge the pixels on the scan line 103*b*. The data on the scan line 103*b* is outputted by the drive IC 11 to the pixels on the scan line 103*b* during a period 106 of the second inverted clock signal 16. According to the first clock signal 10, the first inverted clock signal 14, the second clock signal 12 and the second inverted clock signal 16, the image data DATA is written by the drive IC 11 into all the pixels on the array.

With the dot inversion driving method, the data of two adjacent pixels have different polarities (POLs). That is, the data of pixels on the scan line 101*b* and the data of pixels on the scan line 101*g* have opposite polarities. The data of pixels on the scan line 101*g* and data of pixels on the scan line 101*r* have opposite polarities, too. For example, if the pixel data on the scan lines 101*b*, 101*r* and 103*g* have a positive polarity, then the data of pixels on the scan lines 101*g*, 103*b* and 103*r* have a negative polarity. Consequently, when the pixels on the scan line 101*g* are being pre-charged during the period 102*p* of the second clock signal 12, the data that will be written into the pixels on the scan lines 101*b* will also be written into the pixels on the scan line 101*g* simultaneously. However, opposite data polarities of the adjacent pixels lead to the significant difference between the image data thereof. More specifically, as the scan line 101*g* is being pre-charged, there is a significant difference between the data written into the pixels on the scan line 101*b* and the data that should be written into the pixels on the scan line 101*g*, which will adversely impact the image displaying quality of the LCD 1. Likewise, when the pixels on the scan line 101*r* are being pre-charged during the period 104*p* of the first inverted clock signal 14, data that will be written into the pixels on the scan lines 101*g* will also be written into the pixels on the scan line 101*r* simultaneously. When the pixels on the scan line 103*b* are pre-charged during the period 106*p* of the second inverted clock signal 16, data that will be written into the pixels on the scan lines 101*r* will also be written into the pixels on the scan line 103*b* simultaneously. Hence, whenever a scan line is pre-charged, opposite polarities will occur between the data written into the pixels on the scan line and the data that ought to be ultimate written therein. As a result, there are errors in writing the data of the three colors in each frame period.

To overcome this problem, there are many different driving methods that have been proposed in the prior art. For instance, FIG. 1C is a schematic clock diagram of individual scan lines that have adopted a one-three line dot inversion driving method. As shown in FIG. 1C, the drive IC 11 outputs one pixel data of a positive polarity and then outputs three pixel data of a negative polarity in succession. To be more specific, the data of pixels on the scan lines 101*b*, 103*g* have a positive polarity, while the data of the pixels on the scan lines 101*g*, 101*r*, 103*b*, 103*r* have a negative polarity. It can be seen from FIG. 1C that when the pixels on the scan line 101*g* are pre-charged during a period 102*p* of the second clock signal 12, pixels on the scan line 103*g* are pre-charged during a period 108*p* of the first clock signal 10, while the pixels on the scan line 103*r* are pre-charged during a period 110*p* of the second clock signal 12. During this process, opposite polarities will occur between the data written into the pixels on the scan lines during the respective pre-charging processes and the data ought to be ultimate written therein.

FIG. 1D is a schematic clock diagram of individual scan lines that have adopted a two-three line dot inversion driving method. As shown in FIG. 1D, the drive IC 11 outputs two pixel data of a positive polarity and then outputs three pixel data of a negative polarity in succession. To be more specific, the pixel data of the scan lines 101*b*, 101*g*, 103*r* have a positive polarity, while the pixel data on the scan lines 101*r*, 103*b*, 103*g* have a negative polarity. Hence, with the two-three line dot inversion driving method, the opposite polarities that occur between the data that is written into the pixels on a scan line during the pre-charging process and the data that ought to be written therein occurs only when the pixels on the scan line 101*r* are being pre-charged during a period 104*p* of the first inverted clock signal 14 and when the pixels on the scan line 103*r* are being pre-charged during a period 101*p* of the second clock signal 12.

FIG. 1E is a schematic clock diagram illustrating the individual scan lines that have adopted a three-three line dot inversion driving method. As shown in FIG. 1E, the drive IC 11 outputs the three pixel data of a positive polarity and then outputs the three pixel data of a negative polarity in succession. To be more specific, the data of the pixels on the scan lines 101*b*, 101*g*, 101*r* have a positive polarity, while the data of pixels on the scan lines 103*b*, 103*g*, 103*r* have a negative polarity. Hence, with the three-three line dot inversion driving method, the opposite polarities between the data written into the pixels on a scan line during the pre-charging process and the data ought to be written therein occurs only when the pixels on the scan line 103*b* are being pre-charged during a period 106*p* of the second inverted clock signal 16.

Although the dot inversion driving methods described above may enhance the driving capability of an LCD that adopts a GOA technology, when the drive IC 11 sends image data DATA to the pixels. However, they all lead to an erroneous polarity in writing the data of a particular color, thus causing an adverse impact on the quality of an image displayed by the LCD 1.

In view of this, it is highly desirable in the art to provide an LCD with an SOG that can prevent erroneous polarities from occurring between the pixels of the LCD when the image data is being written, thereby improving the quality of an image displayed by the LCD.

SUMMARY OF THE INVENTION

In view of above shortcomings of the conventional dot inversion driving methods, one objective of this invention is to improve the poor image displaying quality caused by the dot inversion driving methods in an LCD that adopts a GOA. Accordingly, this invention provides an LCD apparatus, which comprises a pixel array, a POL signal generator and a drive circuit. The pixel array having a plurality of pixels is configured to display an image having a first frame, a second frame, a third frame, a fourth frame, a fifth frame and a sixth frame. The POL signal generator is configured to generate a plurality of POL signals comprising a first POL signal, a second POL signal, a third POL signal, a fourth POL signal, a fifth POL signal and a sixth POL signal. The drive circuit is configured to output the data of the first frame according to the first POL signal to furnish the pixel array to display the first frame, output the data of the second frame according to the second POL signal to furnish the pixel array to display the second frame, output the data of the third frame according to the third POL signal to furnish the pixel array to display the third frame, output the data of the fourth frame according to the fourth POL signal to furnish the pixel array to display the fourth frame, output the data of the fifth frame according to the fifth POL signal to furnish the pixel array to display the fifth frame, and output the data of the sixth frame according to the sixth POL signal to furnish the pixel array to display the sixth frame.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1A:
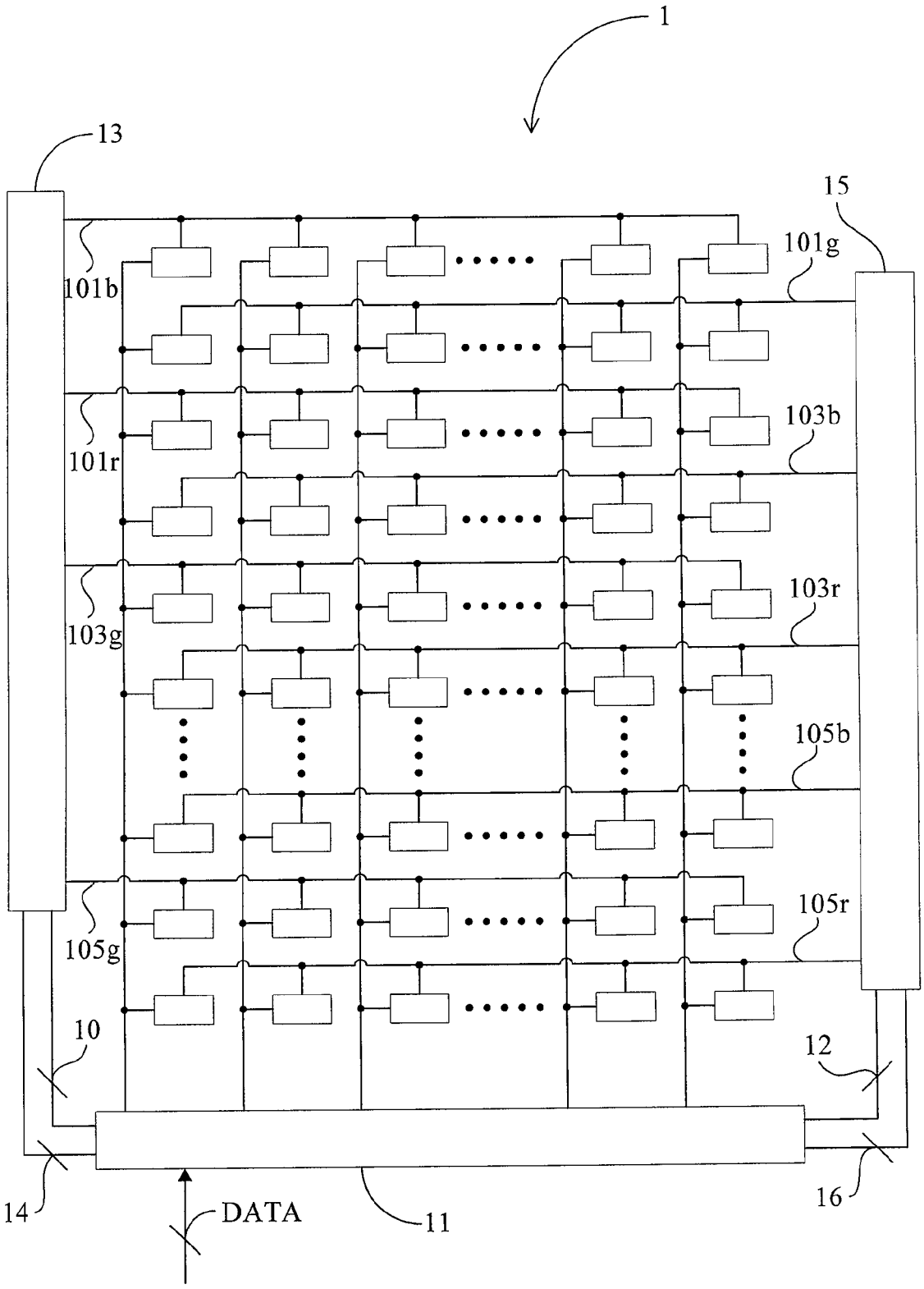
FIG. 1A (Prior Art)
FIG. 1A is a schematic diagram illustrating a conventional LCD adopting an SOG.
Figure 1B:
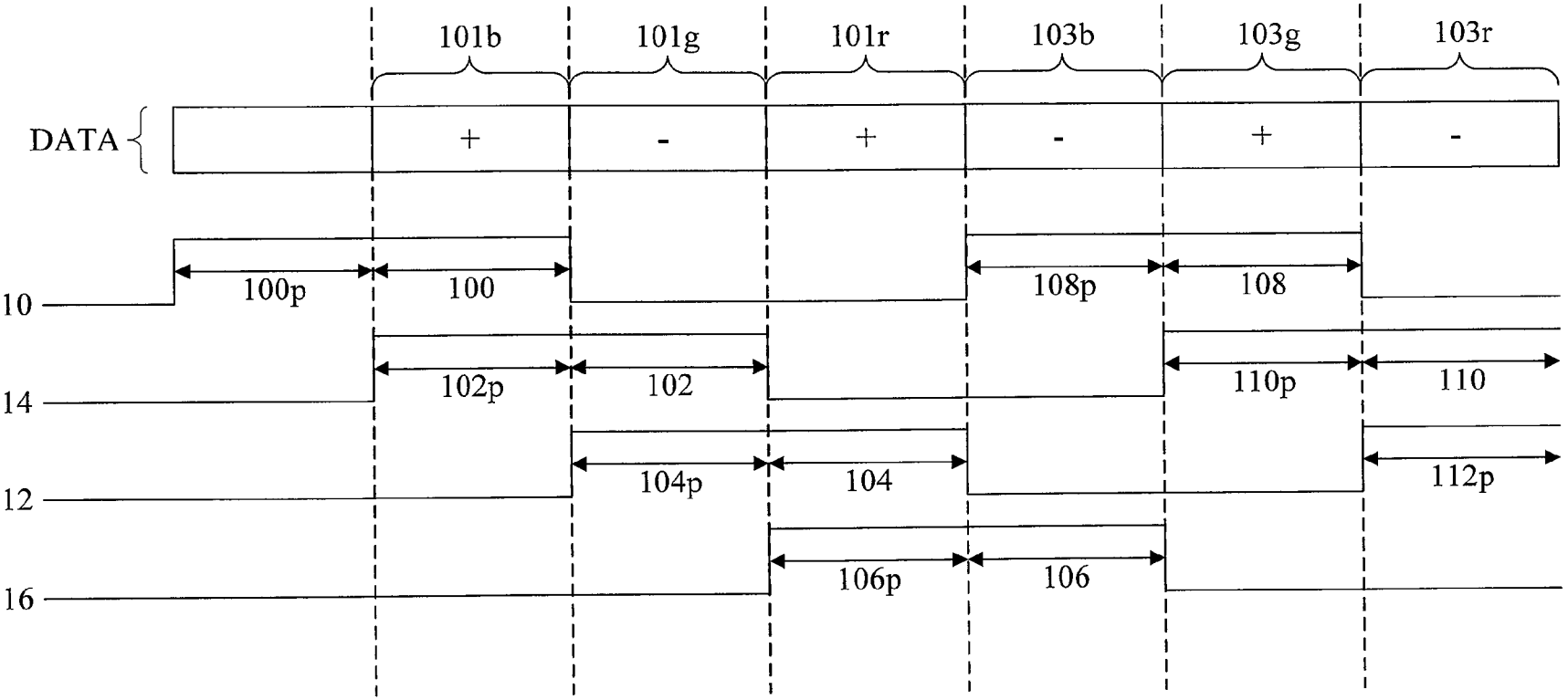
FIG. 1B (Prior Art)
FIG. 1B is a schematic clock diagram illustrating the individual scan lines adopting the dot inversion driving method that is used.
Figure 1C:
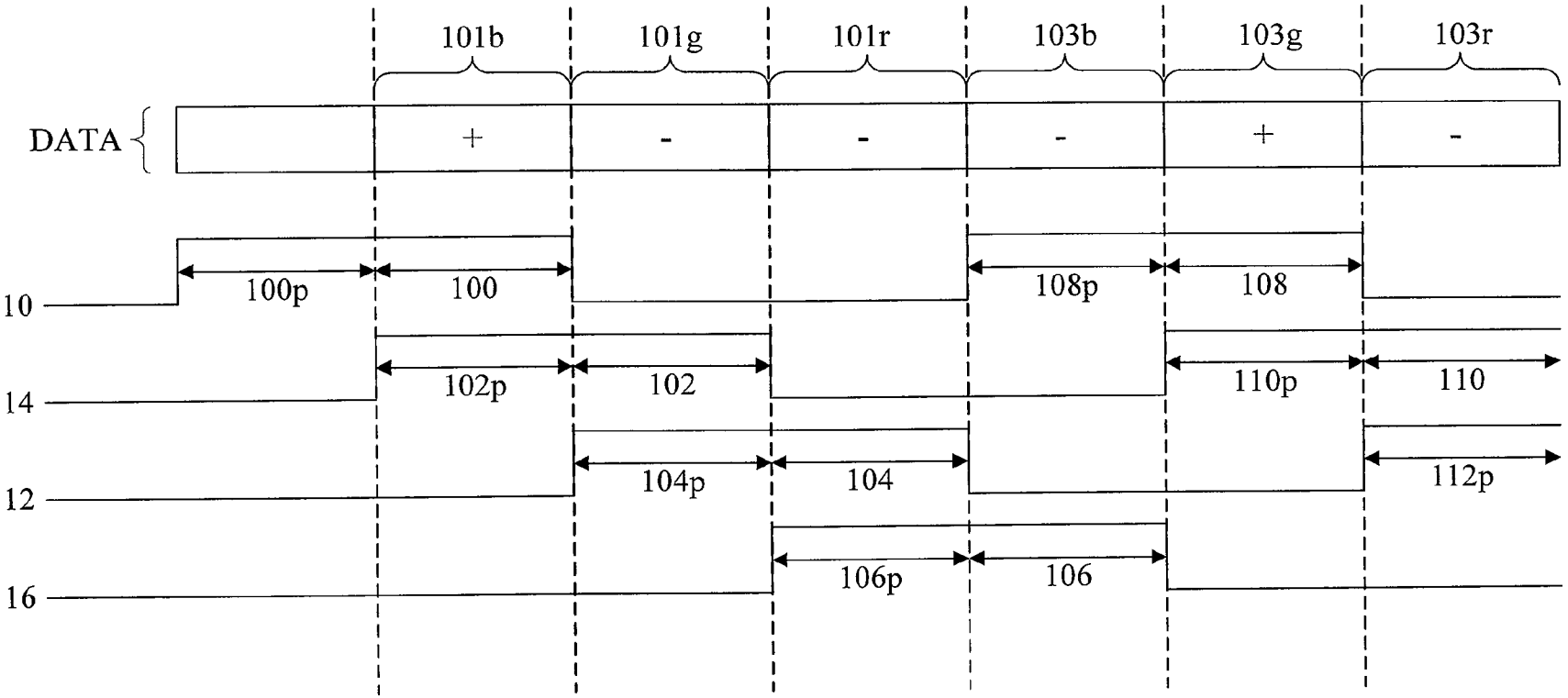
FIG. 1C (Prior Art)
FIG. 1C is a schematic clock diagram illustrating the individual scan lines adopting the one-three line dot inversion driving method.
Figure 1D:
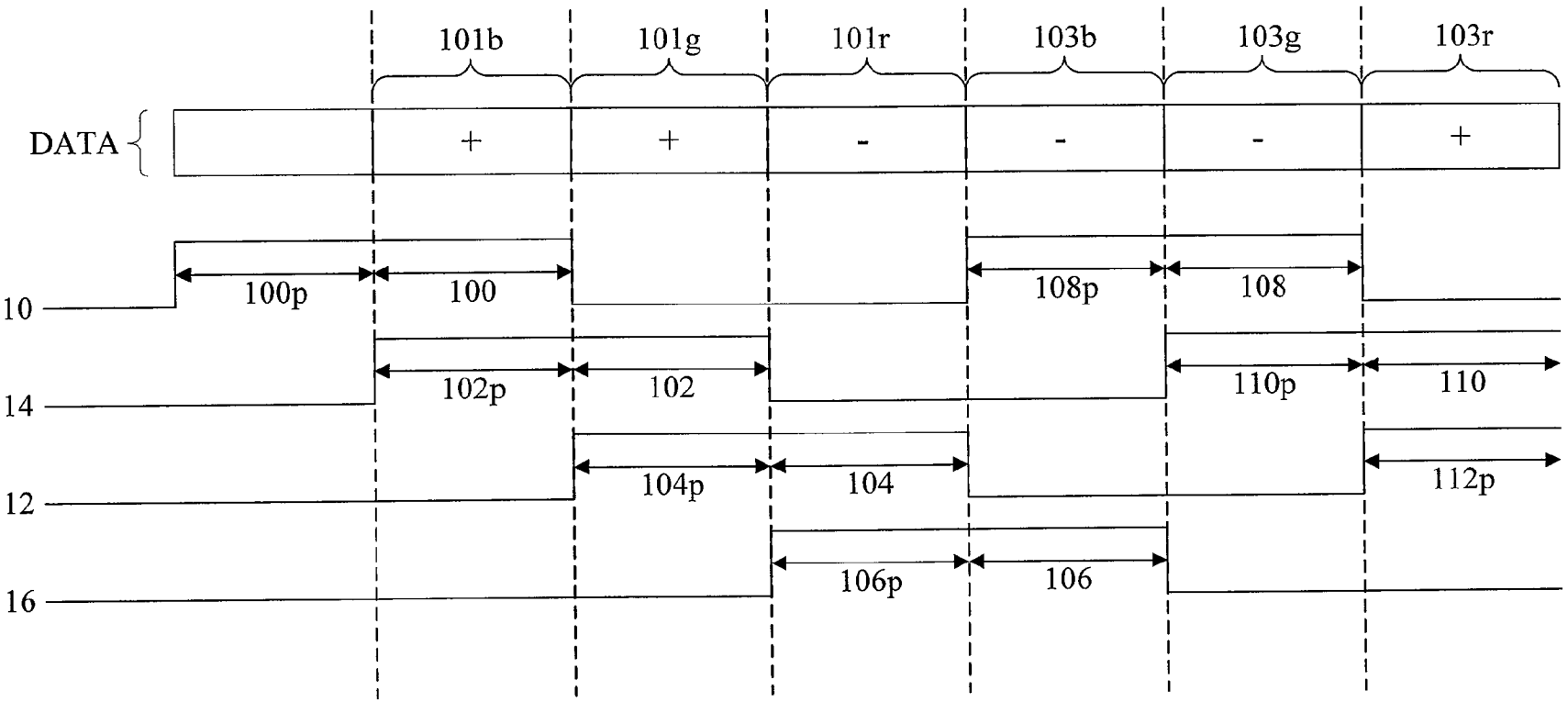
FIG. 1D (Prior Art)
FIG. 1D is a schematic clock diagram illustrating the individual scan lines adopting the two-three line dot inversion driving method.
Figure 1E:
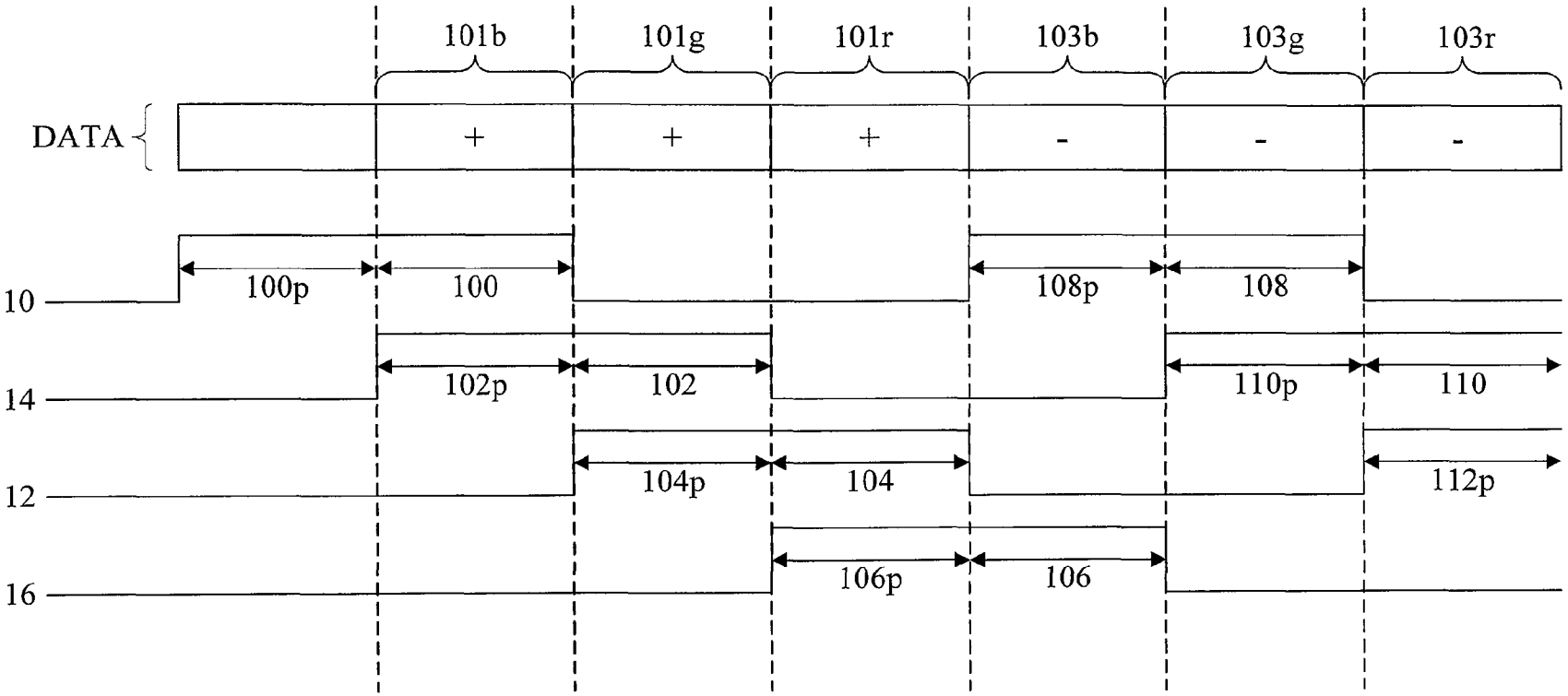
FIG. 1E (Prior Art)
FIG. 1E is a schematic clock diagram illustrating the individual scan lines adopting the three-three line dot inversion driving method.
Figure 2:
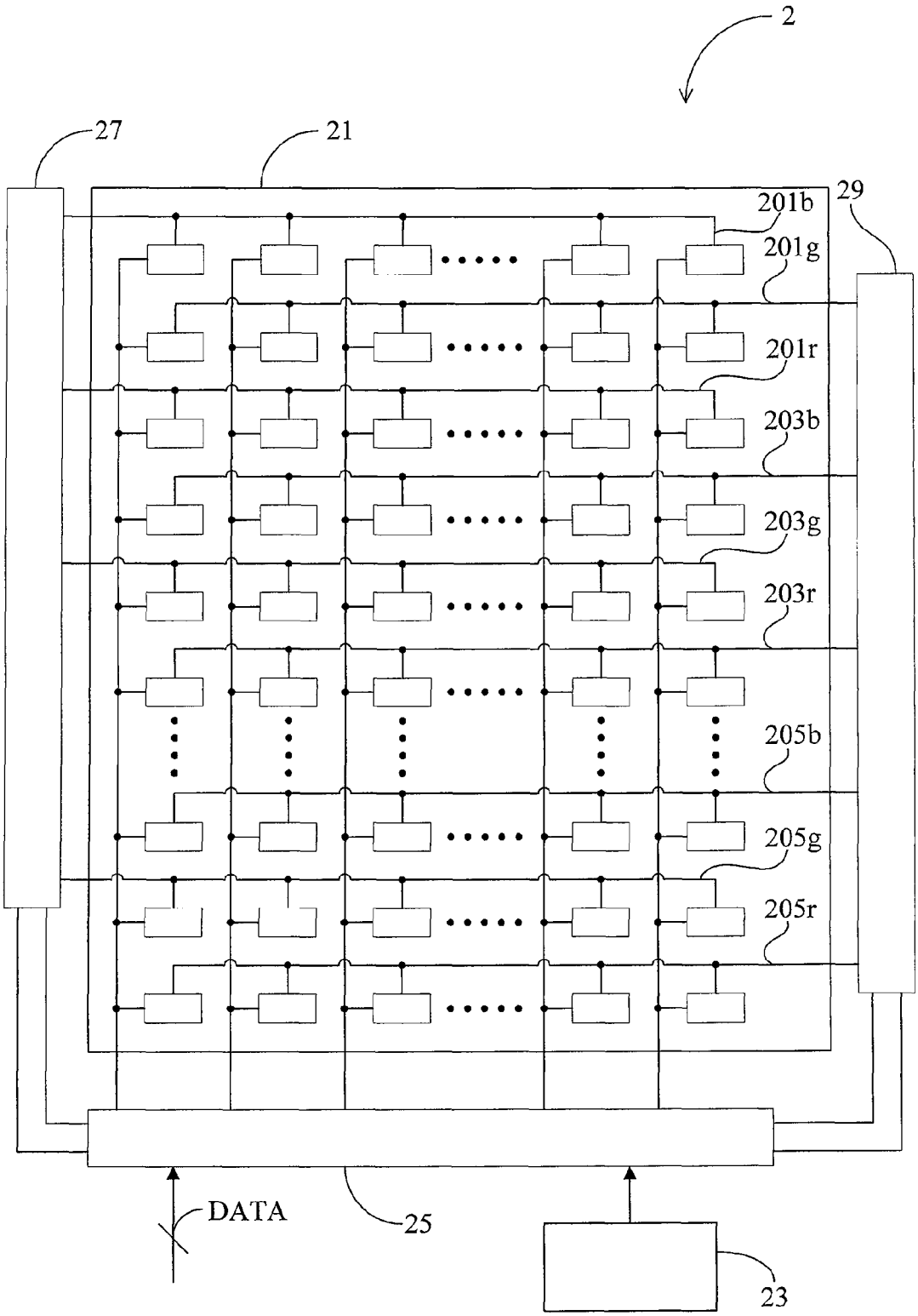
FIG. 2 is a schematic view of a first embodiment of this invention.

FIG. 2 depicts a first embodiment of this invention, which is an LCD apparatus 2 comprising a pixel array 21, a POL signal generator 23, a drive circuit 25, a first gate circuit 27 and a second gate circuit 29. The pixel array 21 comprises a plurality of scan lines (for simplicity, only 201*b*, 201*g*, 201*r*, 203*b*, 203*g*, 203*r*, 205*b*, 205*g*, 205*r* are denoted in FIG. 2). The scan lines comprise a plurality of pixels configured to display an image having a plurality of frames. The POL signal generator 23 is configured to generate a plurality of POL signals with different formats and input them into the drive circuit 25. Then the drive circuit 25 changes the polarities of the data DATA in different frames of the image according to these POL signals with different formats and input the data DATA of the different frames to the pixel array 21, so that the pixel array 21 displays the image through the operations of the first gate circuit 27 and the second gate circuit 29.

In a preferred embodiment of this invention, the drive circuit 25 changes the polarities of the data DATA in the different frames of an image according to the POL signals of different formats, including the POL signals outputted by the dot inversion driving method, the one-three line dot inversion driving method, the two-three line dot inversion driving method and the three-three line dot inversion driving method. By adopting these different driving methods in combination with the outputted POL signals, the poor quality of the frame display caused by the erroneous polarities is prevented. Hereinafter, the polarities of the data in the different frames that are outputted with the different combinations will be described.

Figure 3:
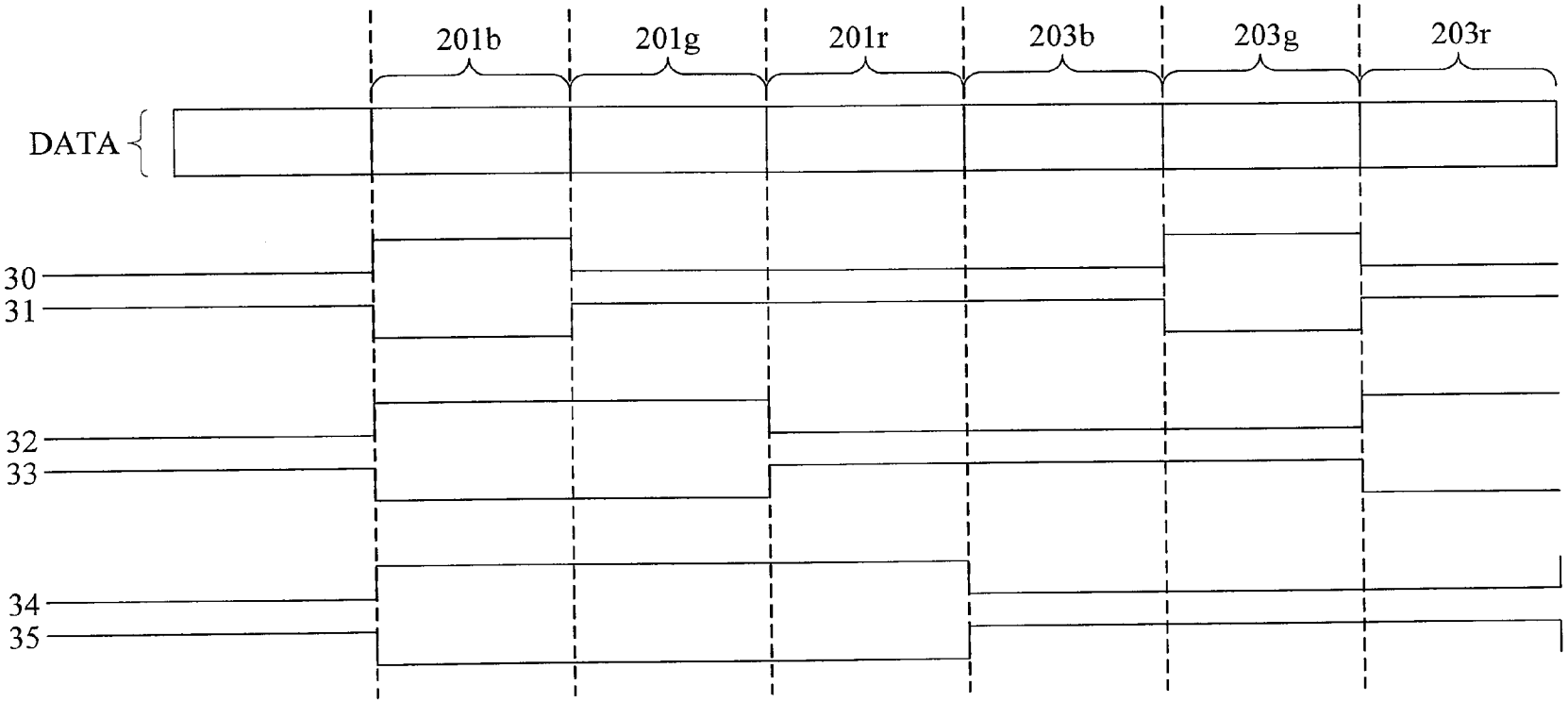
FIG. 3 is a schematic clock diagram of each POL signal of this invention.

FIG. 3 is a schematic view of the POL signals of the individual frame data with one of the combinations. When the drive circuit 25 of the LCD apparatus 2 outputs a first frame of an image to the pixel array 21, the first frame will be outputted to the pixel array 21 via the drive circuit 25 according to a first POL signal 30 generated by the POL signal generator 23. More specifically, the first frame of the image is outputted to the pixel array 21 according to the positive POL signal 30 of the one-three line dot inversion driving method. At this point, the data of the pixels on the scan lines 201*b*, 203*g* have a positive polarity, while the data of pixels on the scan lines 201*g*, 201*r*, 203*b*, 203*r* have a negative polarity.

When the drive circuit 25 of the LCD apparatus 2 outputs a second frame of the image to the pixel array 21, the second frame will be outputted to the pixel array 21 via the drive circuit 25 according to a second POL signal 31 generated by the POL signal generator 23. More specifically, the second frame of the image is outputted to the pixel array 21 according to the negative POL signal 31 of the one-three line dot inversion driving method. At this point, the data of the pixels on the scan lines 201*g*, 201*r*, 203*b*, 203*r* have a positive polarity, while the data of pixels on the scan lines 201*b*, 203*g* have a negative polarity. It can be seen from FIG. 3 that the first POL signal 30 and the second POL signal 31 have opposite phases to each other.

When the drive circuit 25 of the LCD apparatus 2 outputs a third frame of the image to the pixel array 21, the third frame will be outputted to the pixel array 21 via the drive circuit 25 according to a third POL signal 32 generated by the POL signal generator 23. More specifically, the third frame of the image is outputted to the pixel array 21 according to the positive POL signal 32 of the two-three line dot inversion driving method. At this point, the pixel data on the scan lines 201*b*, 201*g*, 203*r* have a positive polarity, while the pixel data on the scan lines 201*r*, 203*b*, 203*g* have a negative polarity.

When the drive circuit 25 of the LCD apparatus 2 outputs a fourth frame of the image to the pixel array 21, the fourth frame will be outputted to the pixel array 21 via the drive circuit 25 according to a fourth POL signal 33 generated by the POL signal generator 23. More specifically, the fourth frame of the image is outputted to the pixel array 21 via the drive circuit 25 according to the negative POL signal 33 of the two-three line dot inversion driving method. At this point, the pixel data on the scan lines 201*r*, 203*b*, 203*g* have a positive polarity, while the pixel data on the scan lines 201*b*, 201*g*, 203*r* have a negative polarity. It can be seen from FIG. 3 that the third POL signal 32 and the fourth POL signal 33 have opposite phases to each other.

When the drive circuit 25 of the LCD apparatus 2 outputs a fifth frame of the image to the pixel array 21, the fifth frame will be outputted to the pixel array 21 via the drive circuit 25 according to a fifth POL signal 34 generated by the POL signal generator 23. More specifically, the fifth frame of the image is outputted to the pixel array 21 according to the positive POL signal 34 of the three-three line dot inversion driving method. At this point, the pixel data on the scan lines 201*b*, 201*g*, 201*r* have a positive polarity, while the pixel data on the scan lines 203*b*, 203*g*, 203*r* have a negative polarity.

When the drive circuit 25 of the LCD apparatus 2 outputs a sixth frame of the image to the pixel array 21, the sixth frame will be outputted to the pixel array 21 via the drive circuit 25 according to a sixth POL signal 35 generated by the POL signal generator 23. More specifically, the sixth frame of the image is outputted to the pixel array 21 according to the negative POL signal 35 of the three-three line dot inversion driving method. At this point, the pixel data on the scan lines 203*b*, 203*g*, 203*r* have a positive polarity, while the pixel data on the scan lines 201*b*, 201*g*, 201*r* have a negative polarity. It can be seen from FIG. 3 that the fifth POL signal 34 and the sixth POL signal 35 have opposite phases to each other.

Likewise, a seventh to a twelfth frame of the image are outputted to the pixel array 21 via the drive circuit 25 by adopting one of the aforesaid one-three, two-three or three-three line dot inversion driving methods. By circularly changing the POL signals, the erroneous polarities occur only once every two frames, which means that there will be significantly fewer erroneous polarities compared to those provided by the solutions of the prior art.

Figure 4:
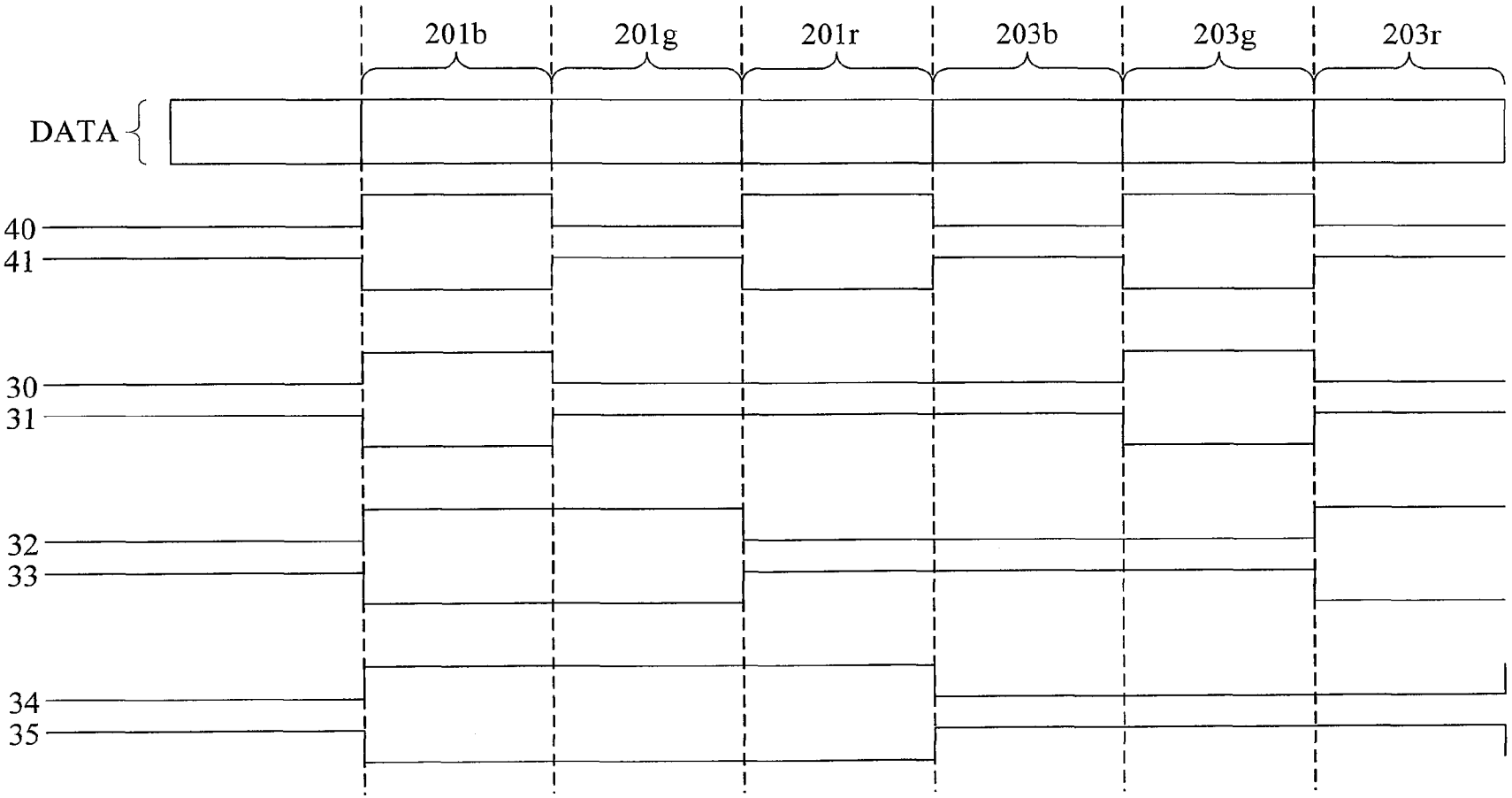
FIG. 4 is another schematic clock diagram of each POL signal of this invention.

FIG. 4 illustrates the POL signals of individual frame data with a different combination. In this combination, only a seventh POL signal 40 and an eighth POL signal 41 are additionally generated by the POL signal generator 23, so as to be used in combination with the aforementioned POL signals to output the frames. More specifically, the POL signal generator 23 generates a positive polarity signal 40 and a negative polarity signal 41 of the dot inversion driving method to adjust the polarities of frame data on the scan lines 201*b*, 201*g*, 201*r*, 203*b*, 203*g*, 203*r*. This invention is not limited to the number of POL signals used in combination, i.e., it is not just limited to the six or the eight POL signals described in this embodiment; instead, the POL signal generator 23 may generate merely two or more than two POL signals to adjust the polarities of frame data on the scan lines. Those of ordinary skill in the art may also use a different number of POL signals to accomplish the objective of this invention, and this will not be described herein.

Figure 5:
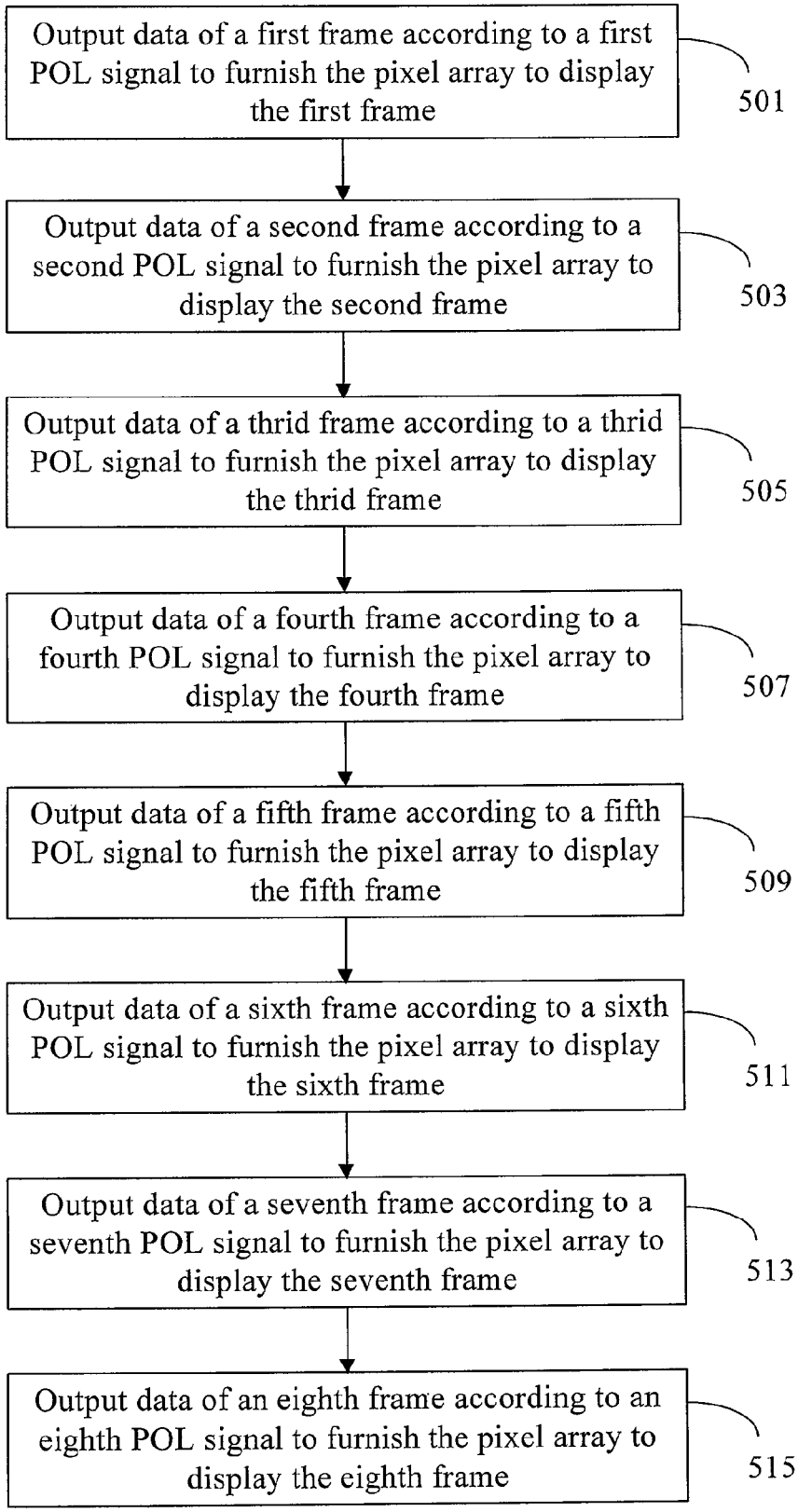
FIG. 5 is a flow chart of a second embodiment of this invention.

FIG. 5 depicts a second embodiment of this invention, which is a method for a pixel array to display an image. This method is applied to the LCD apparatus 2 described in the first embodiment and is illustrated as follows.

Initially in step 501, the data from the first frame is outputted according to the first POL signal to furnish the pixel array to display the first frame. Next in step 503, the data of the second frame is outputted according to the second POL signal to furnish the pixel array to display the second frame. Then in step 505, the data of the third frame is outputted according to the third POL signal to furnish the pixel array to display the third frame. Subsequently in step 507, the data of the fourth frame is outputted according to the fourth POL signal to furnish the pixel array to display the fourth frame. Then in step 509, data of the fifth frame is outputted according to the fifth POL signal to furnish the pixel array to display the fifth frame. In step 511, the data of the sixth frame is outputted according to the sixth POL signal to furnish the pixel array to display the sixth frame. Next in step 513, the data of the seventh frame is outputted according to the seventh POL signal to furnish the pixel array to display the seventh frame. Finally in step 515, the data of the eighth frame is outputted according to the eighth POL signal to furnish the pixel array to display the eighth frame.

In addition to the steps depicted in FIG. 5, the second embodiment is able to execute all of the operations or functions mentioned in the first embodiment. Those of ordinary skill in the art will appreciate how the embodiment depicted in FIG. 5 executes these operations and functions upon reviewing the above descriptions of the first embodiment. Therefore, this will not be further described herein.

In conclusion, by changing the POL signals, erroneous polarities of the frame data caused by each conventional dot inversion driving method can be reduced, thus improving the quality of the images displayed by an LCD.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A method for a pixel array to display an image, the image having a first frame, a second frame, a third frame, a fourth frame, a fifth frame and a sixth frame, the method comprising the following steps:

outputting data of the first frame according to a first polarity (POL) signal to furnish the pixel array to display the first frame;

outputting data of the second frame according to a second POL signal to furnish the pixel array to display the second frame, wherein the first POL signal and the second POL signal have mutually opposite phases;

outputting data of the third frame according to a third POL signal to furnish the pixel array to display the third frame; and outputting data of the fourth frame according to a fourth POL signal to furnish the pixel array to display the fourth frame, wherein the third POL signal and the fourth POL signal have mutually opposite phases;

outputting data of the fifth frame according to a fifth POL signal to furnish the pixel array to display the fifth frame; and outputting data of the sixth frame according to a sixth POL signal to furnish the pixel array to display the sixth frame, wherein the fifth POL signal and the sixth POL signal have mutually opposite phases;

wherein the first POL signal, the second POL signal, the third POL signal, the fourth POL signal, the fifth POL signal and the sixth POL signal are output circularly by a combination of a dot inversion driving method, a one-three line inversion driving method, a two-three line inversion driving method and a three-three line inversion driving method.

2. The method of claim 1, wherein the image further has a seventh frame and an eighth frame, the method further comprises the following steps:

outputting data of the seventh frame according to a seventh POL signal to furnish the pixel array to display the seventh frame; and outputting data of the eighth frame according to an eighth POL signal to furnish the pixel array to display the eighth frame.

3. The method of claim 2, wherein the seventh POL signal and the eighth POL signal have mutually opposite phases, and the first POL signal, the second POL signal, the third POL signal, the fourth POL signal, the fifth POL signal, the sixth POL signal, the seventh POL signal and the eighth POL signal are output circularly by a combination of a dot inversion driving method, a one-three line inversion driving method, a two-three line inversion driving method and a three-three line inversion driving method.

4. A displaying apparatus, comprising:

a pixel array being configured to display an image, the image having a first frame, a second frame, a third frame, a fourth frame, a fifth frame and a sixth frame;

a POL signal generator being configured to generate a plurality of POL signals, the POL signals comprising a first POL signal, a second POL signal, a third POL signal, a fourth POL signal, a fifth POL signal and a sixth POL signal; and a drive circuit being configured to output data of the first frame according to the first POL signal to furnish the pixel array to display the first frame; to output data of the second frame according to the second POL signal to furnish the pixel array displays the second frame; to output data of the third frame according to the third POL signal to furnish the pixel array to display the third frame, to output data of the fourth frame according to the fourth POL signal to furnish the pixel array to display the fourth frame, to output data of the fifth frame according to the fifth POL signal to furnish the pixel array to display the fifth frame, and to output data of the sixth frame according to the sixth POL signal to furnish the pixel array to display the sixth frame, wherein the first POL signal and the second POL signal have mutually opposite phases, the third POL signal and the fourth POL signal have mutually opposite phases, and the fifth POL signal and the sixth POL signal have mutually opposite phases;

wherein the first POL signal, the second POL signal, the third POL signal, the fourth POL signal, the fifth POL signal and the sixth POL signal are output circularly by a combination of a dot inversion driving method, a one-three line inversion driving method, a two-three line inversion driving method and a three-three line inversion driving method.

5. The displaying apparatus of claim 4 wherein the image further has a seventh frame and an eighth frame, the POL signals further comprise a seventh POL signal and an eighth POL signal, the drive circuit is configured to output data of the seventh frame according to the seventh POL signal to furnish the pixel array to display the seventh frame, and to output data of the eighth frame according to the eighth POL signal to furnish the pixel array to display the eighth frame.

6. The displaying apparatus of claim 5, wherein the seventh POL signal and the eighth POL signal have mutually opposite phases, and the first POL signal, the second POL signal, the third POL signal, the fourth POL signal, the fifth POL signal, the sixth POL signal, the seventh POL signal and the eighth POL signal are output circularly by a combination of a dot inversion driving method, a one-three line inversion driving method, a two-three line inversion driving method and a three-three line inversion driving method.

* * * * *